US011728076B2

(12) United States Patent
Itagaki et al.

(10) Patent No.: US 11,728,076 B2
(45) Date of Patent: Aug. 15, 2023

(54) METHOD OF PRODUCING LAMINATED AMORPHOUS ALLOY RIBBON HOLDING SPOOL AND METHOD OF PRODUCING IRON CORE

(71) Applicant: Proterial, Ltd., Tokyo (JP)

(72) Inventors: Hajime Itagaki, Tokyo (JP); Atsuhiro Noguchi, Tokyo (JP); Morifumi Kuroki, Tokyo (JP); Makoto Sasaki, Tokyo (JP)

(73) Assignee: Proterial, Ltd., Tokyo (JP)

( * ) Notice: Subject to any disclaimer, the term of this patent is extended or adjusted under 35 U.S.C. 154(b) by 147 days.

(21) Appl. No.: 17/529,953

(22) Filed: Nov. 18, 2021

(65) Prior Publication Data

US 2022/0172868 A1 Jun. 2, 2022

(30) Foreign Application Priority Data

Nov. 30, 2020 (JP) ..... 2020-197913

(51) Int. Cl.

| | |
|---|---|
| ***H01F 1/153*** | (2006.01) |
| ***C22C 45/02*** | (2006.01) |
| ***H01F 3/04*** | (2006.01) |
| ***H01F 41/02*** | (2006.01) |

(52) U.S. Cl.

CPC ..... *H01F 1/15308* (2013.01); *C22C 45/02* (2013.01); *H01F 1/15341* (2013.01); *H01F 3/04* (2013.01); *H01F 41/0226* (2013.01)

(58) Field of Classification Search

None

See application file for complete search history.

(56) References Cited

U.S. PATENT DOCUMENTS

| | | | | |
|---|---|---|---|---|
| 4,328,411 | A * | 5/1982 | Haller | H02K 15/026 225/2 |
| 2012/0154084 | A1* | 6/2012 | Yoshizawa | H01F 1/15341 335/297 |
| 2021/0098175 | A1* | 4/2021 | Nakajima | H01F 27/25 |

FOREIGN PATENT DOCUMENTS

| | | | |
|---|---|---|---|
| JP | S6129103 | A | 2/1986 |
| JP | S61258404 | A | 11/1986 |
| JP | H0332886 | A | 2/1991 |
| WO | 2019189813 | A1 | 10/2019 |

* cited by examiner

*Primary Examiner* — Brian D Walck

(74) *Attorney, Agent, or Firm* — David D. Brush; Westman, Champlin & Koehler, P.A.

(57) ABSTRACT

A method of producing a laminated amorphous alloy ribbon holding spool. The method includes providing amorphous alloy ribbon holding spools, each of which is wound with a single layer amorphous alloy ribbon, unwinding the single layer amorphous alloy ribbon from each of the amorphous alloy ribbon holding spools, making the single layer amorphous alloy ribbon travel with a laser being radiated thereto, to thereby simultaneously prepare single layer amorphous alloy ribbons having laser irradiation mark formed thereon, laminating the single layer amorphous alloy ribbons having the laser irradiation mark formed thereon to, thereby prepare a laminated amorphous alloy ribbon, and winding up the laminated amorphous alloy ribbon on a spool.

16 Claims, 6 Drawing Sheets

METHOD OF PRODUCING LAMINATED AMORPHOUS ALLOY RIBBON HOLDING SPOOL AND METHOD OF PRODUCING IRON CORE

CROSS-REFERENCE TO RELATED APPLICATIONS

This application claims the benefit of Japanese Patent Application No. 2020-197913 filed on Nov. 30, 2020 with the Japan Patent Office, the entire disclosure of which is incorporated herein by reference.

BACKGROUND

The present disclosure relates to a method of producing a laminated amorphous alloy ribbon holding spool and a method of producing an iron core.

Amorphous alloy ribbons have become increasingly popular, for example, as iron core materials for transformers.

As a method of reducing anomalous eddy current loss of an amorphous alloy ribbon, there are known methods such as a method comprising mechanically scratching a surface of the amorphous alloy ribbon, and a laser scribing method comprising radiating a laser beam to a surface of the amorphous alloy ribbon to locally melt the surface and rapidly solidify the ribbon, thereby subdividing magnetic domains.

Japanese Examined Patent Application Publication No. H3-32886, for example, discloses a laser scribing method comprising radiating a pulse laser in a width direction of an amorphous alloy ribbon to locally and instantaneously melt a surface of the amorphous alloy ribbon, and then rapidly solidifying the ribbon to form a series of amorphized spots in the shape of a dotted line, thereby subdividing magnetic domains.

Japanese Unexamined Patent Application Publication No. S61-258404 discloses radiating a laser beam with the laser beam being swept in a width direction of an amorphous alloy ribbon while the amorphous alloy ribbon has a surface temperature of 300° C. or higher. This Patent Document discloses an example of radiating a laser beam to a free surface of the ribbon with a YAG pulse laser device while the amorphous alloy ribbon, which has rapidly solidified on a surface of a cooling roll, is in contact with the cooling roll. The cooling roll has a peripheral speed of 10 m/sec, and conditions for radiating the laser beam are: a laser power of 200 W; a frequency of 20 kHz; a beam diameter of 0.15 mm; and a sweeping speed of 25 m/sec.

Japanese Unexamined Patent Application Publication No. S61-29103 discloses a method of improving magnetic properties of an amorphous alloy ribbon, the method comprising locally and instantaneously melting a surface of an amorphous alloy ribbon, then rapidly solidifying and non-crystallizing again the ribbon, and thereafter annealing the ribbon. In this disclosure, laser irradiation conditions when a YAG laser is radiated to a free surface of the amorphous alloy ribbon to introduce a locally melted part are: a frequency of 400 Hz; a beam diameter of 0.2 mmφ; an output of 5 w; a line speed of 2 cm/sec; and a beam sweeping speed of 10 cm/sec.

SUMMARY

Conventionally, efforts have been made to improve iron loss by radiating a laser to an amorphous alloy ribbon. The amorphous alloy ribbon, for example, is used as an iron core of a power converter such as a power transformer or a high frequency transformer. The amorphous alloy ribbon for a power transformer or a high frequency transformer is required to have high performance. However, simply having high performance does not mean wide acceptance in the market. For wide acceptance in the market, high productivity, and cost that is not excessive are required. High performance here means, for example, having a low iron loss, a low coercive force, and a low exciting power.

As mentioned above, it has been known that iron loss is improved by radiating a laser to the amorphous alloy ribbon. However, the laser-radiated amorphous alloy ribbon has not been widely available in the market. This is believed to be due to lack of productivity that can be accepted in the market.

An iron core using an amorphous alloy ribbon is formed by winding an amorphous alloy ribbon or laminating amorphous alloy ribbons. In this regard, it is required to efficiently produce a lamination of amorphous alloy ribbons that have been irradiated with a laser.

It is desirable that the present disclosure provides a method of producing a laminated amorphous alloy ribbon holding spool that enables efficient laser irradiation and efficient lamination of amorphous alloy ribbons that have been irradiated with a laser.

Also, it is desirable to provide a method of producing an iron core that enables efficient iron core production.

The present disclosure comprises the following modes.

<1> A method of producing a laminated amorphous alloy ribbon holding spool comprising:

providing single layer amorphous alloy ribbon holding spools, each of which is wound with a single layer amorphous alloy ribbon;

unwinding the single layer amorphous alloy ribbon from each of the single layer amorphous alloy ribbon holding spools;

making the single layer amorphous alloy ribbon travel with a laser being radiated thereto, to thereby simultaneously prepare single layer amorphous alloy ribbons having laser irradiation marks formed thereon;

laminating the single layer amorphous alloy ribbons having the laser irradiation marks formed thereon, to thereby prepare a laminated amorphous alloy ribbon; and winding up the laminated amorphous alloy ribbon on a spool.

<2> The method of producing a laminated amorphous alloy ribbon holding spool according to <1>, wherein when the single layer amorphous alloy ribbon has a traveling speed of S1 m/sec and the laser has a scanning speed of S2 m/sec, the S1 is 0.1 m/sec or more and 30 m/sec or less, the S2 is 1 m/sec or more and 800 m/sec or less, and S2/S1 is 3.0 or more.

<3> The method of producing a laminated amorphous alloy ribbon holding spool according to <1> or <2>, wherein an angle difference between a scanning direction of the laser and a direction orthogonal to a traveling direction of the single layer amorphous alloy ribbon is 30 degrees or less.

<4> The method of producing a laminated amorphous alloy ribbon holding spool according to any one of <1> to <3>, wherein a distance from a lens through which the laser is output to a surface of the single layer amorphous alloy ribbon is 200 mm to 1200 mm.

<5> The method of producing a laminated amorphous alloy ribbon holding spool according to any one of <1> to <4>, wherein the laser uses a CW (continuous wave) oscillation method.

<6> The method of producing a laminated amorphous alloy ribbon holding spool according to <5>, wherein the laser using a CW (continuous wave) oscillation method has a laser output energy density of 5 J/m or more and 35 J/m or less.

<7> The method of producing a laminated amorphous alloy ribbon holding spool according to any one of <1> to <4>, wherein the laser is a pulse laser.

<8> The method of producing a laminated amorphous alloy ribbon holding spool according to <7>, wherein the pulse laser has a laser pulse output energy of 0.4 mJ to 2.5 mJ.

<9> The method of producing a laminated amorphous alloy ribbon holding spool according to any one of <1> to <8>, wherein the single layer amorphous alloy ribbon has a width of 30 mm to 300 mm, and a thickness of 18 μm to 35 μm.

<10> The method of producing a laminated amorphous alloy ribbon holding spool according to any one of <1> to <9>, wherein the laser irradiation marks are linear marks formed in a width direction of the single layer amorphous alloy ribbon and the linear marks are formed in a longitudinal direction of the single layer amorphous alloy ribbon with an interval left.

<11> The method of producing a laminated amorphous alloy ribbon holding spool according to <10>, wherein the interval between the linear marks in the longitudinal direction of the single layer amorphous alloy ribbon is 2 mm to 200 mm.

<12> The method of producing a laminated amorphous alloy ribbon holding spool according to any one of <1> to <11>, wherein a mechanism for suppressing oscillation the single layer amorphous alloy ribbon is provided in front and rear of a portion of the single layer amorphous alloy ribbon to be irradiated with the laser.

<13> The method of producing a laminated amorphous alloy ribbon holding spool according to <12>, wherein the mechanism for suppressing oscillation of the single layer amorphous alloy ribbon adjusts a traveling position of the single layer amorphous alloy ribbon with rolls.

<14> A method of producing a laminated amorphous alloy ribbon holding spool comprising:

providing laminated amorphous alloy ribbon holding spools obtained by the method according to any one of <1> to <13>;

unwinding laminated amorphous alloy ribbons from the laminated amorphous alloy ribbon holding spools;

laminating the laminated amorphous alloy ribbons, to thereby prepare a laminated amorphous alloy ribbon; and winding up the laminated amorphous alloy ribbon on a spool.

<15> A method of producing an iron core comprising:

unwinding a laminated amorphous alloy ribbon from at least one laminated amorphous alloy ribbon holding spool obtained by the method according to any one of <1> to <14>;

working the laminated amorphous alloy ribbon, to thereby form laminated amorphous alloy ribbon pieces; and laminating the laminated amorphous alloy ribbon pieces and/or bending the laminated amorphous alloy ribbon pieces, to thereby form an iron core.

<16> The method of producing an iron core according to <15>, wherein the at least one laminated amorphous alloy ribbon holding spool includes laminated amorphous alloy ribbon holding spools, the method comprising: unwinding a laminated amorphous alloy ribbon from each of the laminated amorphous alloy ribbon holding spools;

working the laminated amorphous alloy ribbon, to thereby form laminated amorphous alloy ribbon pieces; and laminating the laminated amorphous alloy ribbons and/or bending the laminated amorphous alloy ribbons.

According to the present disclosure, it is possible to provide a method of producing a laminated amorphous alloy ribbon holding spool that enables efficient laser irradiation and efficient lamination of laminate amorphous alloy ribbons that have been irradiated with a laser. Furthermore, according to the present disclosure, it is possible to provide a method of producing a laminated amorphous alloy ribbon holding spool with high productivity. Still furthermore, according to the present disclosure, it is possible to obtain a laminated amorphous alloy ribbon consisting of a lamination of high performance amorphous alloy ribbons. Still furthermore, according to the present disclosure, it is possible to form an iron core with a laminated amorphous alloy ribbon consisting of efficiently laminated amorphous alloy ribbons that have been irradiated with a laser.

BRIEF DESCRIPTION OF THE DRAWINGS

Example embodiments of the present disclosure will be described hereinafter with reference to the accompanying drawings, in which.

DETAILED DESCRIPTION OF EXEMPLARY EMBODIMENTS

Figure 1:
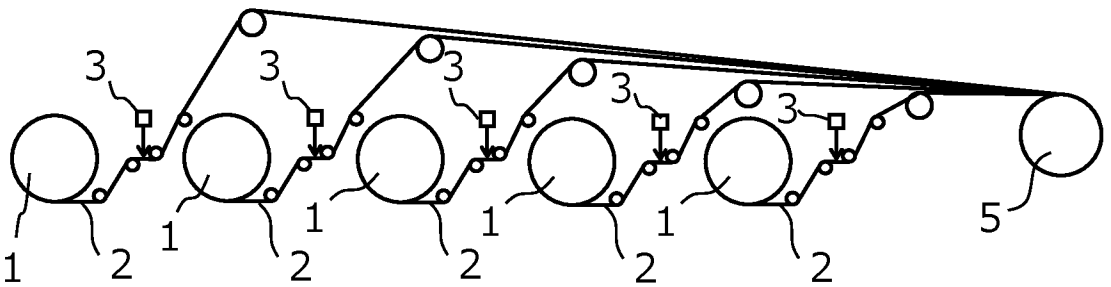
FIG. 1 is a diagram showing a method of producing a laminated amorphous alloy ribbon holding spool according to one embodiment of the present disclosure.

Embodiments of the present disclosure will be described in detail hereinafter. The present disclosure is not limited to the following embodiments, and can be practiced with appropriate modifications within the scope not departing from the spirit of the present disclosure.

When the embodiments of the present disclosure are described with reference to the drawings, descriptions on components and reference signs overlapping in the drawings may be omitted. The components shown in the drawings with the same reference signs mean that they are the same components. Dimensional ratios in the drawings do not necessarily represent the actual dimensional ratios.

In the present disclosure, a numerical range represented using "(from) . . . to . . . " indicates a range encompassing respective numerical values described before and after "to" as a lower limit and an upper limit. In numerical ranges described stepwise in the present disclosure, an upper limit value or a lower limit value described in one numerical range may be replaced with an upper limit value or a lower limit value of another numerical range described stepwise. The upper limit value or the lower limit value described in a certain numerical range described in the present disclosure may be replaced with a value shown in Examples.

In the present disclosure, a combination of two or more preferred modes is a more preferred mode.

Figure 2:
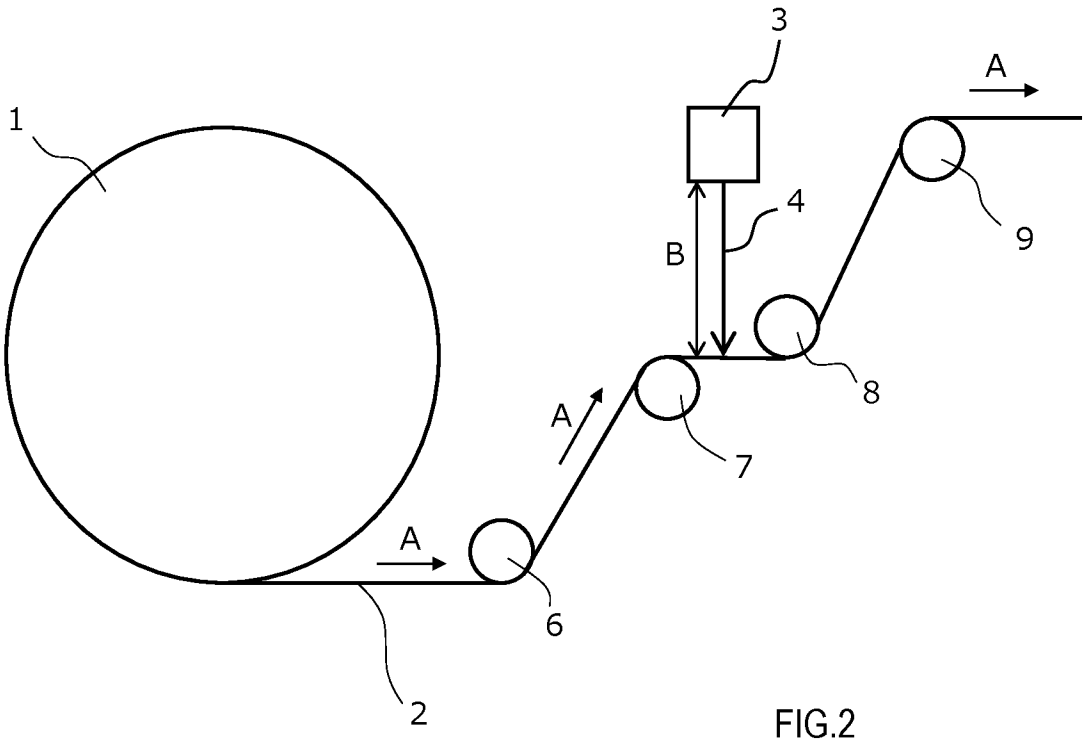
FIG. 2 is an enlarged view of a portion of a single layer amorphous alloy ribbon of FIG. 1 to be irradiated with a laser.

First, descriptions are given, by way of FIG. 2, to a method of radiating a laser to a single layer amorphous alloy ribbon according to one example of the present disclosure. In the present disclosure, the "single layer amorphous alloy ribbon" is also simply referred to as "amorphous alloy ribbon".

In one embodiment of the present disclosure, the method of radiating a laser to a single layer amorphous alloy ribbon comprises unwinding an amorphous alloy ribbon 2 from a single layer amorphous alloy ribbon holding spool 1 that holds a wound single layer amorphous alloy ribbon, and making the amorphous alloy ribbon 2 travel in a direction indicated by an arrow A.

A path where the amorphous alloy ribbon travels is provided with a laser irradiation device 3. The laser irradiation device 3 radiates a laser 4 to the amorphous alloy ribbon. The amorphous alloy ribbon 2, which has been irradiated with the laser and on which laser irradiation marks have been formed, travels in the direction indicated by the arrow A. In the present disclosure, the amorphous alloy ribbon to be irradiated with the laser is the single layer amorphous alloy ribbon. Furthermore, the laser irradiation marks are traces of the laser that has been radiated.

Descriptions are given, by way of FIG. 1, to the method of producing a laminated amorphous alloy ribbon holding spool according to one example of the present disclosure.

The method of producing a laminated amorphous alloy ribbon holding spool according to one example of the present disclosure comprises a plurality of methods of radiating a laser to single layer amorphous alloy ribbons described above. Specifically, the method comprises simultaneously performing the plurality of methods of radiating a laser to a single layer amorphous alloy ribbon, to thereby prepare single layer amorphous alloy ribbons on which laser irradiation marks have been formed, laminating the single layer amorphous alloy ribbons on which the laser irradiation marks have been formed, and then winding up a laminated amorphous alloy ribbon consisting of the single layer amorphous alloy ribbons on a spool.

In other words, this producing method comprises radiating lasers to amorphous alloy ribbons unwound from spools and subsequently laminating the amorphous alloy ribbons, followed by winding up of a lamination of the amorphous alloy ribbons on one spool. That is, this producing method is performed continuously from a spool to another spool.

In an embodiment illustrated in FIG. 1, provided are five single layer amorphous alloy ribbon holding spools 1 and five laser irradiation devices 3. The amorphous alloy ribbon 2 unwound from each single layer amorphous alloy ribbon holding spool 1 is irradiate with the laser while traveling. Consequently, five single layer amorphous alloy ribbons on which laser irradiation marks have been formed can be simultaneously prepared. The five single layer amorphous alloy ribbons having the irradiation marks formed thereon are laminated, and a laminated amorphous alloy ribbon (consisting of five layers of amorphous alloy ribbons) is wound up on a spool 5. Accordingly, the five layers of amorphous alloy ribbons, which are made into one set, are wound around the spool 5, whereby a laminated amorphous alloy ribbon holding spool can be produced.

In the present embodiment, the laminated amorphous alloy ribbon consists of the five amorphous alloy ribbons in one set. However, the number of the amorphous alloy ribbons is not limited to five, and may be freely changed. The single layer amorphous alloy ribbon holding spool 1 and the laser irradiation device 3 can be provided in any required number corresponding to the number of the amorphous alloy ribbons.

Furthermore, the present disclosure can employ a method of producing a laminated amorphous alloy ribbon holding spool comprising further laminating laminated amorphous alloy ribbons unwound from spools 5 holding laminated amorphous alloy ribbons prepared in accordance with the above method, and winding up a laminated amorphous alloy ribbon consisting of a lamination of the laminated amorphous alloy ribbons on a spool.

For example, there may be a case where five laminated amorphous alloy ribbon holding spools, each of which is wound with a five-layered laminated amorphous alloy ribbon, is provided and respective five-layered laminated amorphous alloy ribbons are laminated. In this case, a laminated amorphous alloy ribbon holding spool wound with a lamination of twenty-five layers of amorphous alloy ribbons can be produced. The number of laminated amorphous alloy ribbon holding spools can be appropriately set.

During forming of the laser irradiation marks on the amorphous alloy ribbon, it is preferable to radiate the laser with the amorphous alloy ribbon traveling in order to improve productivity.

For the purpose of improving productivity, a traveling speed of the amorphous alloy ribbon is set to 0.1 m/sec or more, preferably 1 m/sec or more, and more preferably 2 m/sec or more.

When the traveling speed of the amorphous alloy ribbon is too fast, it is difficult to stably radiate the laser, and the form of the laser irradiation marks is disturbed. Therefore, the traveling speed of the amorphous alloy ribbon is set to 30 m/sec or less, preferably 20 m/sec or less, more preferably 10 m/sec or less, and still more preferably 9 m/sec or less.

In order to radiate the laser to the traveling amorphous alloy ribbon to form intended laser irradiation marks, and for stable laser output, a scanning speed of the laser is set to 1 m/sec or more, preferably 2 m/sec or more, and more preferably 3 m/sec or more. Further, the scanning speed of the laser may be 10 m/sec or more, or 35 m/sec or more. Also, when the scanning speed of the laser exceeds 800 m/sec, it is difficult to stably radiate the laser to the traveling amorphous alloy ribbon, and the form of the laser irradiation marks is disturbed. Therefore, the scanning speed of the laser is set to 800 m/sec or less, preferably 500 m/sec or less, and more preferably 300 m/sec or less.

If the scanning speed of the laser is too slow or too fast with respect to the traveling speed of the amorphous alloy ribbon, the laser irradiation becomes unstable, and it becomes difficult to stably form the laser irradiation marks. As a result, it becomes difficult to form the intended laser irradiation marks while maintaining productivity. Therefore, when the traveling speed of the amorphous alloy ribbon is set to S1 m/sec and the scanning speed of the laser is set to S2 m/sec, S2/S1 is set to 3.0 or more, preferably 5.0 or more, more preferably 7 or more, and still more preferably 10 or more. In addition, S2/S1 is set to preferably 300 or less, and more preferably 100 or less.

It is preferable to set a distance, from a lens through which the laser of the laser irradiation device 3 is output to a surface of the laser-radiated amorphous alloy ribbon 2, to 200 mm to 1200 mm. This allows the traveling amorphous alloy ribbon 2 to form the intended laser irradiation marks. If the distance is less than 200 mm, the laser focal depth is shallow, and the laser is out of focus. Thus, the laser cannot be stably radiated. Also, if the distance exceeds 1200 mm, a laser beam diameter becomes wide, and the intended laser irradiation marks cannot be obtained. Accordingly, the distance is more preferably 250 mm or more, still more preferably 260 mm or more, still more preferably 270 mm or more, and still more preferably 300 mm or more. In addition, the distance is more preferably 1000 mm or less, and still more preferably 800 mm or less.

The distance from the lens through which the laser of the laser irradiation device 3 is output to the surface of the laser-radiated amorphous alloy ribbon 2 is shown by a reference sign B in FIG. 2.

In the method of producing an amorphous alloy ribbon according to one embodiment of the present disclosure, the amorphous alloy ribbon 2 is conveyed via rolls 6 to 9. These rolls allow the amorphous alloy ribbon 2 to travel to an intended position. Therefore, arrangement and the number of rolls can be adjusted in accordance with the intended position.

The rolls 7, 8 function as a mechanism that suppresses oscillation of the amorphous alloy ribbon 2 when the laser is radiated. Therefore, a distance between the rolls 7, 8 and a position where the laser is radiated on the amorphous alloy ribbon 2 (distance between the position where the laser is radiated on the amorphous alloy ribbon 2 and a position where the amorphous alloy ribbon 2 contacts the roll 7 or the roll 8) should not be too far. For example, it is preferable that the distance is within 200 mm.

The laser irradiation marks of the present disclosure are linear marks formed in a width direction of the amorphous alloy ribbon, and the linear marks are preferably formed in a longitudinal direction of the amorphous alloy ribbon with an interval left. The linear marks may be in the shape of a dotted line formed with a pulse laser, or in the shape of a line formed with a laser that uses a CW (continuous wave) oscillation method.

It is preferable that the interval between the laser irradiation marks (linear marks) in the longitudinal direction of the amorphous alloy ribbon (hereinafter, also referred to as line interval) is 2 mm to 200 mm. The line interval may be the shortest length between the adjacent linear marks. The line interval may be more preferably 3.5 mm or more, still more preferably 5 mm or more, still more preferably 10 mm or more, and still more preferably 15 mm or more. In addition, the line interval is more preferably 100 mm or less, still more preferably 80 mm or less, and still more preferably 60 mm or less. The line interval may be further narrowed to 50 mm or less, 40 mm or less, and 30 mm or less.

It is preferable that a pulse laser or a laser that uses a CW (continuous wave) oscillation method is used for the laser that forms the laser irradiation marks.

In the case of using the pulse laser, for example, the form of laser irradiation marks disclosed in WO2019/189813 can be used.

When the pulse laser is used, a laser irradiation mark is formed as a dotted linear mark including a series of dot-like laser irradiation marks arranged in the width direction of the amorphous alloy ribbon with an interval left. This dotted linear mark is plurally formed in a traveling direction of the amorphous alloy ribbon with an interval left.

It is preferable that the interval between the dot-like laser irradiation marks (hereinafter, spot interval) is 0.10 mm to 0.50 mm. By forming the laser irradiation marks at intervals as such, reduction in iron loss and reduction of increase in exciting power can be expected. In particular, it is effective in reduction of iron loss and exciting power measured under a condition of a frequency of 60 Hz and a magnetic flux density of 1.45 T.

It is also preferable that the interval between the dotted linear marks in the traveling direction of the amorphous alloy ribbon (hereinafter, line interval) is 10 mm to 60 mm.

It is also preferable that, when the line interval is dl (mm), the spot interval is d2 (mm), and a number density D of the dot-like laser irradiation marks is $D=(1/d1)\times(1/d2)$, the number density D is 0.05 pieces/mm$^2$ to 0.50 pieces/mm$^2$.

With the line interval and the number density as above, reduction in iron loss of the amorphous alloy ribbon and reduction of increase in exciting power can be expected. In particular, it is effective in reduction of iron loss and exciting power measured under the condition of a frequency of 60 Hz and a magnetic flux density of 1.45 T.

It is preferable that a laser pulse output energy of the pulse laser is 0.4 mJ to 2.5 mJ.

Also, in the case of using the laser that uses a CW (continuous wave) oscillation method (hereinafter, also referred to as CW laser), the laser irradiation mark is a linear mark continuous in the width direction of the amorphous alloy ribbon. The linear mark may have an intermittent linear shape.

The linear mark by the CW laser is a trace of the radiated laser, and irregularities are formed on the surface of the amorphous alloy ribbon. It is preferable that, when the irregularities are evaluated in the traveling direction of the amorphous alloy ribbon, a difference HL between the highest point and the lowest point in a thickness direction of the amorphous alloy ribbon is 0.20 μm to 2.0 μm.

It is also preferable that HL x WL calculated based on a difference HL between the highest point and the lowest point of the linear mark and a line width WL of the linear mark is 6 μm$^2$ to 180 μm$^2$. The line width WL of the linear mark is a width of the linear mark in the traveling direction of the amorphous alloy ribbon.

It is also preferable that the line width WL is 28 μm or more.

It is preferable that, when the interval between the mutually adjacent linear marks is a line interval, the line interval is 2 mm to 200 mm. By forming the linear marks at the line interval, reduction in iron loss and reduction of increase in exciting power can be expected. In particular, it is effective in reduction of iron loss and exciting power measured under the condition of a frequency of 60 Hz and a magnetic flux density of 1.45 T.

The line interval is more preferably 3.5 mm or more, still more preferably 5 mm or more, still more preferably 10 mm or more, and still more preferably 15 mm or more. Also, the line interval is more preferably 100 mm or less, still more preferably 80 mm or less, and still more preferably 60 mm or less. The line interval may be further narrowed to 50 mm or less, 40 mm or less, and 30 mm or less.

It is preferable that the laser output energy density of the CW laser is 5 J/m or more and 35 J/m or less, more preferably 6 J/m or more, still more preferably 7 J/m or more, still more preferably 8 J/m or more, and still more preferably 10 J/m or more. Also, the laser output energy density of the CW laser is more preferably 31 J/m or less, still more preferably 30 J/m or less, still more preferably 28

J/m or less, and still more preferably 25 J/m or less. The laser output energy density is also referred to as laser line density.

When the CW laser is used in forming the laser irradiation marks, a YAG laser, a $CO_2$ gas laser, a fiber laser, or a diode laser can be used as a laser beam source. Above all, a fiber laser is preferable since the fiber laser can stably radiate a high-quality laser beam for a long period of time. In the case of a single mode fiber laser, $M^2$ (M square), which represents beam quality, is about 1.3 or less. In the fiber laser, a laser beam introduced into a fiber oscillates on the principle of FBG (Fiber Bragg Grating) by diffraction gratings at both ends of the fiber. Since the laser beam is excited in the elongated fiber, there is no problem of a thermal lens effect in which the beam quality is deteriorated due to a temperature gradient generated inside the crystal. Furthermore, since a fiber core is as thin as a few microns, the laser beam can propagate in a single mode even at a high output. Thus, the beam diameter is narrowed and a laser beam having a high energy density can be obtained. Moreover, since the focal depth is deep, laser irradiation marks can be accurately formed even on a wide ribbon (for example, a ribbon having a width of 300 mm or more).

When the CW laser is used, a wavelength of the laser beam is about 250 nm to 10600 nm depending on the laser beam source. A wavelength of 900 nm to 1100 nm is suitable since the laser beam is sufficiently absorbed in an alloy ribbon.

It is preferable that the laser beam has a beam diameter of 10 μm or more and 500 μm or less, and more preferably 25 μm or more and 100 μm or less.

The above-described dotted linear mark or linear mark is formed in a direction along the width of the amorphous alloy ribbon. The width direction of the amorphous alloy ribbon indicates a direction orthogonal to the traveling direction of the amorphous alloy ribbon.

It is preferable that a ratio of a length of the linear mark to the total length in the width direction of the amorphous alloy ribbon is 10% to 50% in a direction from the center in the width direction to each end in the width direction. The "%" herein is used to represent the ratio when the entire length in the width direction of the amorphous alloy ribbon is 100%.

When the linear mark is tilted with respect to the width direction, not the length of the tilted linear mark itself but a value obtained by converting the length to a length in the width direction of the ribbon at a location where the linear mark is formed is defined as the length in the width direction of the linear mark.

If the ratio of the length of the linear mark is 50%, this means that the linear mark extends from the center in the width direction of the amorphous alloy ribbon to one end and the other end in the width direction. In other words, it is a state in which the linear mark is formed from one end to the other end in the width direction of the amorphous alloy ribbon.

If the ratio of the length of the linear mark is 10%, this means that the linear mark has a length of 10% of the amorphous alloy ribbon in the direction from the center in the width direction to each end in the width direction. That is, there is a linear mark having a 20% length of the length in the width direction of the amorphous alloy ribbon in a center region of the amorphous alloy ribbon. In other words, it means that the amorphous alloy ribbon has the linear mark formed at its each end in the width direction leaving a margin of 40% to the entire length in the width direction of the amorphous alloy ribbon.

It is preferable that the ratio of the length in the width direction of the linear mark to the entire length in the width direction of the amorphous alloy ribbon is 25% or more in the direction from the center in the width direction to each end in the width direction.

The linear mark is formed in the width direction of the amorphous alloy ribbon.

The width direction of the amorphous alloy ribbon is the direction orthogonal to the traveling direction of the amorphous alloy ribbon, and a direction perpendicular to the longitudinal direction of the long amorphous alloy ribbon.

In the present disclosure, "in the width direction of the amorphous alloy ribbon" is not limited to a direction perpendicular to the longitudinal direction of the long amorphous alloy ribbon. Even if there is a tilt with respect to the perpendicular direction, it is interpreted as corresponding to "in the width direction".

In the present disclosure, it is preferable that "in the width direction" means that the linear mark is parallel to or forms an angle of 30 degrees or less in a direction perpendicular to the longitudinal direction of the amorphous alloy ribbon. This angle is more preferably 10 degrees or less.

Since the linear mark is formed in the width direction of the amorphous alloy ribbon, a scanning direction of the laser is the same as a forming direction of the linear mark.

The laser is radiated while the amorphous alloy ribbon is traveling. Therefore, strictly speaking, the forming direction of the linear mark and the scanning direction of the laser are not exactly the same. However, since the scanning speed of the laser is faster than the traveling speed of the amorphous alloy ribbon, the two directions are generally similar.

For example, in forming the linear mark in parallel to the width direction, it is preferable that the scanning direction of the laser is slightly tilted with respect to the width direction, in consideration of the traveling speed of the amorphous alloy ribbon.

It is preferable that an angle difference between the scanning direction of the laser and the direction orthogonal to the traveling direction of the amorphous alloy ribbon is 30 degrees or less, more preferably 10 degrees or less, and still more preferably 5 degrees or less.

Figure 4:
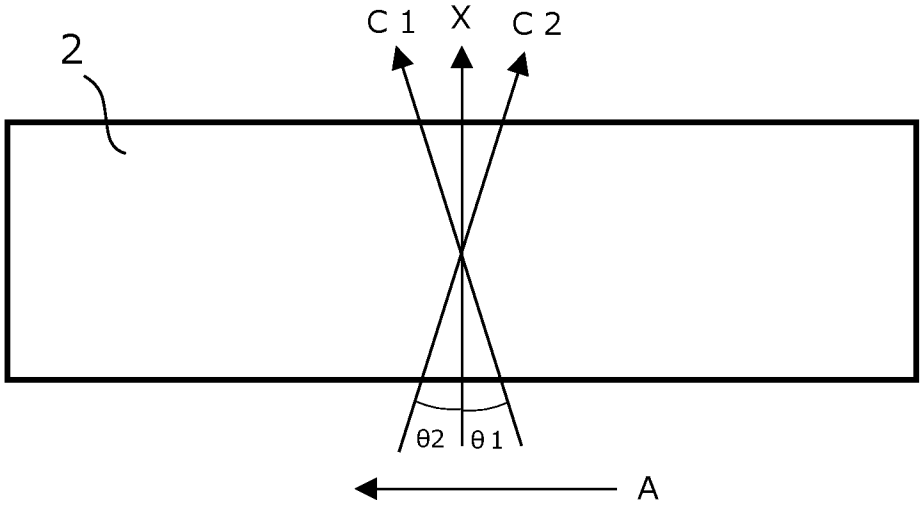
FIG. 4 is a diagram illustrating a relationship between a traveling direction of the single layer amorphous alloy ribbon of the present disclosure and a scanning direction of the laser.

The scanning direction and the forming direction will be explained with reference to FIG. 4. FIG. 4 shows a plan view of the amorphous alloy ribbon. The traveling direction of the amorphous alloy ribbon 2 is indicated by an arrow A. The direction orthogonal to the traveling direction of the amorphous alloy ribbon 2 is indicated by an arrow X. Examples of the scanning direction of the laser are indicated by arrows C1 and C2. Angle differences between the scanning directions C1 and C2 of the laser and the direction X orthogonal to the traveling direction of the amorphous alloy ribbon are θ1 and θ2, respectively. It is preferable that the θ1 and θ2 are 30 degrees or less.

It is preferable that the amorphous alloy ribbon is produced (cast) by a single roll method. The amorphous alloy ribbon produced by the single roll method has a surface that has been brought into contact with a cooling roll and rapidly solidified during casting (also referred to as "roll contact surface") and a surface opposite to the roll contact surface (namely, a surface that has been exposed to the atmosphere during the casting, and is also referred to as "free solidified surface").

The longitudinal direction of the amorphous alloy ribbon corresponds to a casting direction when the amorphous alloy ribbon is produced by a single roll method, which is a direction corresponding to a peripheral direction of the cooling roll. Also, the casting direction and the traveling direction are the same.

It is preferable that the amorphous alloy ribbon of the present disclosure has a width of 30 mm to 300 mm.

If the width is 30 mm or more, productivity can be increased. More preferably, the width is 60 mm or more. It is not easy to produce a wide amorphous alloy ribbon and therefore, productivity tends to decrease if the width exceeds 300 mm.

There is no particular limitation on the thickness of the amorphous alloy ribbon of the present disclosure, but the thickness is preferably 18 μm to 35 μm. If the thickness is 18 μm or more, it is advantageous in terms of suppressing waviness of the amorphous alloy ribbon and improving a space factor. If the thickness is 35 μm or less, it is advantageous in terms of suppressing embrittlement and magnetic saturation of the amorphous alloy ribbon. The thickness of the amorphous alloy ribbon is more preferably 20 μm to 30 μm.

There is no particular limitation on the chemical composition of the amorphous alloy ribbon of the present disclosure. However, it is preferable that the amorphous alloy ribbon has a chemical composition of a Fe based amorphous alloy (namely, chemical composition containing Fe (iron) as a main component).

For example, when the amorphous alloy ribbon comprises Fe, Si, B, and impurities and a total content of Fe, Si, and B is 100 atom %, it is preferable that the chemical composition has a Fe content of 78 atom % or more, a B content of 10 atom % or more, and a total content of B and Si of 17 atom % to 22 atom %.

Impurities may include any element other than Fe, Si, and B. Specifically, for example, impurities may include C, Ni, Co, Mn, 0, S, P, Al, Ge, Ga, Be, Ti, Zr, Hf, V, Nb, Ta, Cr, Mo, and rare earth elements. One type of, or two or more types of these chemical elements may be present as impurities.

These impurity elements can be contained in a range of 1.5% by mass or less in total with respect to the total mass of Fe, Si, and B. The total content of the impurity elements is preferably 1.0% by mass or less, more preferably 0.8% by mass or less, and still more preferably 0.75% by mass or less. Within this range, the impurity elements may be added.

(Iron Core)

An iron core can be formed by unwinding a laminated amorphous alloy ribbon from the laminated amorphous alloy ribbon holding spool of the present disclosure and cutting, punching, etc., the unwound laminated amorphous alloy ribbon, to thereby form laminated amorphous alloy ribbon pieces of a desired shape, followed lamination of the laminated amorphous alloy ribbon pieces. Furthermore, iron cores, which are formed (or have been formed) by laminating laminated amorphous alloy ribbons pieces, can be combined to form an iron core of a desired shape.

Still furthermore, a circular iron core can be formed by unwinding a laminated amorphous alloy ribbon from the laminated amorphous alloy ribbon holding spool of the present disclosure, cutting, punching, etc. the unwound laminated amorphous alloy ribbon, to thereby form laminated amorphous alloy ribbon pieces of a desired shape, laminating the laminated amorphous alloy ribbon pieces, and bending the lamination of the laminated amorphous alloy ribbon pieces to overlap its ends with each other.

Still furthermore, there may be provided laminated amorphous alloy ribbon holding spools. Laminated amorphous alloy ribbons may be unwound from the respective laminated amorphous alloy ribbon holding spools and worked, to thereby form laminated amorphous alloy ribbon pieces. An iron core may be formed with the laminated amorphous alloy ribbon pieces.

The above iron cores can be formed by processing the laminated amorphous alloy ribbon consisting of the lamination of amorphous alloy ribbons on which the laser irradiation marks have been formed. This enables efficient formation of an iron core. Furthermore, the laminated amorphous alloy ribbon of the present disclosure consists of a lamination of amorphous alloy ribbons with high performance and therefore, a high performance iron core can be obtained. The iron core obtained as such can be used for transformers, motors and the like.

EXAMPLES

Example 1

An amorphous alloy ribbon having a chemical composition of $Fe_{82}$ $Si_4$ $B_{14}$ and having a thickness of 25 μm, and a width of 210 mm was produced by a single roll method.

The "chemical composition of $Fe_{82}$ $Si_4$ $B_{14}$" here means a chemical composition which consists of Fe, Si, B, and impurities, and which has a Fe content of 82 atom %, a B content of 14 atom %, and a Si content of 4 atom % when a total content of Fe, Si, and B is 100 atom %.

The amorphous alloy ribbon was produced by retaining a molten metal having the chemical composition of $Fe_{82}$ $Si_4$ $B_{14}$ at a temperature of 1300° C., then ejecting the molten metal through a slit nozzle onto a surface of an axially rotating cooling roll, and rapidly solidifying the ejected molten metal on the surface of the cooling roll.

The produced amorphous alloy ribbon was wound around a spool. As a result, a single layer amorphous alloy ribbon holding spool was prepared.

The ambient atmosphere immediately below the slit nozzle, where a paddle of the molten metal was to be formed, on the surface of the cooling roll was a non-oxidizing gas atmosphere.

The slit length and the slit width of the slit nozzle were 210 mm and 0.6 mm, respectively.

The material of the cooling roll was a Cu-based alloy, and the peripheral speed of the cooling roll was 27 m/sec.

The pressure at which the molten metal is ejected and the nozzle gap (namely, a gap between the tip of the slit nozzle and the surface of the cooling roll) were adjusted so that a maximum cross-sectional height Rt (specifically, maximum cross-sectional height Rt measured along the casting direction of the produced material ribbon) on the free solidified surface of the produced material ribbon is 3.0 μm or less.

Next, as shown in FIG. 1, the five single layer amorphous alloy ribbon holding spools 1 were provided. Then, the amorphous alloy ribbon 2 was unwound from each single layer amorphous alloy ribbon holding spool 1 and was made to travel. In the present example, five mechanisms, each of which has the single layer amorphous alloy ribbon holding spool attached thereto, unwinds the amorphous alloy ribbon, and makes the amorphous alloy ribbon travel, were arranged in line.

The five laser irradiation devices 3, each of which radiates laser to the amorphous alloy ribbon 2, were also provided.

As described above, the five mechanisms, each of which unwinds the single layer amorphous alloy ribbon and radiates the laser while making the single layer amorphous alloy ribbon travel, were arranged in line.

The amorphous alloy ribbon 2 unwound from each of the five single layer amorphous alloy ribbon holding spools 1 was irradiated with the laser while traveling, and thus had laser irradiation marks formed thereon. As a result, the five amorphous alloy ribbons 2, on which the laser irradiation marks had been formed, were simultaneously prepared. Then, the five amorphous alloy ribbons 2 having the laser irradiation marks formed thereon were laminated and wound up on a spool as a five-layered amorphous alloy ribbon, whereby the spool 5 holding a five-layered laminated amorphous alloy ribbon was produced.

The laser irradiation device 3 used was a laser using a CW (continuous wave) oscillation method. The free solidified surface of the amorphous alloy ribbon 2 was irradiated with the laser, to thereby form a linear mark on the free solidified surface of the amorphous alloy ribbon 2. Here, the traveling direction of the amorphous alloy ribbon and the longitudinal direction of the amorphous alloy ribbon were the same directions.

Figure 3:
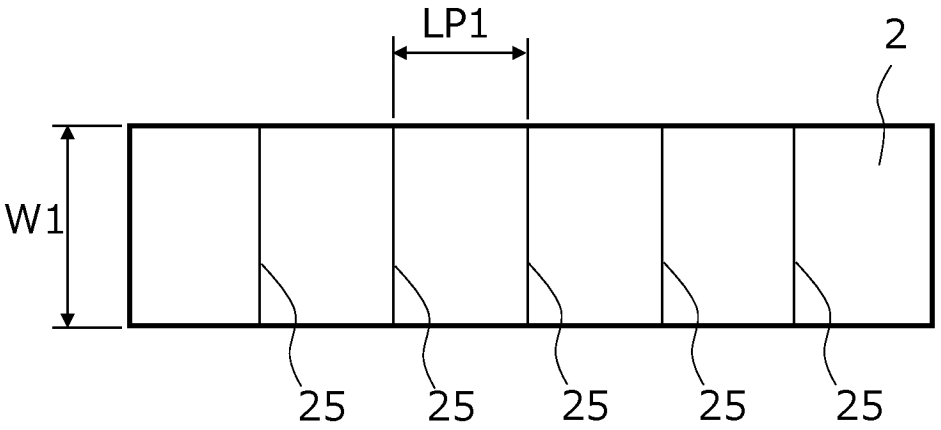
FIG. 3 is a diagram showing one example of the single layer amorphous alloy ribbon of the present disclosure on which laser irradiation marks have been formed.

FIG. 3 shows a schematic diagram of the amorphous alloy ribbon having the linear marks formed thereon. The linear marks 25 were formed in a width direction of the amorphous alloy ribbon 2 from one end to the other end in the width direction.

The linear marks 25 were formed in the width direction of the amorphous alloy ribbon 2, and an angle difference between a forming direction of the linear marks 25 and the longitudinal direction of the amorphous alloy ribbon 2 was 90 degrees (less than one-degree difference from 90 degrees). As described below, the scanning speed of the laser was about 33 times the traveling speed of the amorphous alloy ribbon, which is sufficiently fast.

In the present Example, the scanning direction of the laser, as shown by the arrow C1 of FIG. 4, was set to have an angle of 1.7 degrees (θ1) with respect to a direction (arrow X in FIG. 4) orthogonal to the traveling direction (arrow A in FIG. 4) of the amorphous alloy ribbon 2. As a result, each linear mark 25 was formed in the width direction of the amorphous alloy ribbon 2, and the angle difference between the forming direction of the linear mark 25 and the longitudinal direction of the amorphous alloy ribbon 2 became 90 degrees (less than one-degree difference from 90 degrees).

The linear mark 25 was formed from one end to the other end in the width direction of the amorphous alloy ribbon 2. This means that a ratio of a length in the width direction of the linear mark to a total length in the width direction of the amorphous alloy ribbon was 50% in a direction from the center in the width direction to each end in the width direction.

In the longitudinal direction of the amorphous alloy ribbon, an interval LP1 (line interval) of the mutually adjacent linear marks 25 was 20 mm.

A reference sign W1 indicates the width of the amorphous alloy ribbon. Here, W1 was 210 mm.

Irradiation conditions of the laser using a CW (continuous wave) oscillation method were as follows.

CW laser irradiation conditions:—

- distance from the lens through which the laser of the laser irradiation device 3 is output to the surface of the amorphous alloy ribbon 2 irradiated with the laser: 550 mm
- traveling speed (S1) of the amorphous alloy ribbon: 5 m/sec
- scanning speed (S2) of the laser : 165 m/sec
- S2/S1=33
- laser output energy density: 10 J/m The laser oscillator used was a fiber laser (YLR-150-WC) of IPG Photonics Corporation. The laser medium of the laser oscillator was a glass fiber doped with Yb, and the oscillation wavelength was 1064 nm.

The laser spot diameter on the free solidified surface of the amorphous alloy ribbon 2 was adjusted to 63.0 μm. The beam diameter was adjusted using an f100 mm collimator lens as an optical component and an fθ lens having a focal length of 420 mm.

The beam mode M2 was 1.1 (single mode).

The incident diameter DL and the spot diameter DL0 satisfy a relationship of $DL0=4\lambda f/\pi DL$ (where 2 represents the laser wavelength and f represents the focal length). Thus, as the focal length of the collimator lens increases (namely, as the incident diameter DL increases), the spot diameter DL0 tends to decrease.

With this Example, the amorphous alloy ribbon was unwound from the single layer amorphous alloy ribbon holding spool 1 wound with the single layer amorphous alloy ribbon with a total length of 20000 m, and the laser irradiation marks were formed on the surface of the traveling amorphous alloy ribbon. Specifically, the five amorphous alloy ribbons having the laser irradiation marks formed thereon were simultaneously prepared. The five amorphous alloy ribbons having the laser irradiation marks formed thereon were laminated, to thereby form a laminated amorphous alloy ribbon. The laminated amorphous alloy ribbon was wound up on a spool. As a result, the spool 5 holding a five-layered laminated amorphous alloy ribbon was prepared. In this Example, the laser irradiation marks could be formed while the amorphous alloy ribbon with a total length of 20000 m was continuously traveling. The amorphous alloy ribbons having the laser irradiation marks formed thereon could be continuously laminated and wound up. As a result, a laminated amorphous alloy ribbon holding spool on which a five-layered laminated amorphous alloy ribbon with a total length of 20000 m had been wound up could be produced. In this Example, a sample for measurement was taken from one of the single layer amorphous alloy ribbons having the laser irradiation marks formed thereon, and was subjected to the following evaluation. Results of the evaluation are shown in Table 1.

<Measurement of Iron Loss CL>

The amorphous alloy ribbon having the laser irradiation marks formed thereon was subjected to measurement of the iron loss CL by sinusoidal excitation with an AC magnetic measuring instrument in two conditions including a condition of a frequency of 60 Hz and a magnetic flux density of 1.45 T and a condition of a frequency of 60 Hz and a magnetic flux density of 1.50 T.

<Measurement of Exciting Power VA>

The amorphous alloy ribbon having the laser irradiation marks formed thereon was subjected to measurement of the exciting power VA by sinusoidal excitation with an AC magnetic measuring instrument in two conditions including a condition of a frequency of 60 Hz and a magnetic flux density of 1.45 T and a condition of a frequency of 60 Hz and a magnetic flux density of 1.50 T.

<Measurement of Coercive Force Hc>

The amorphous alloy ribbon having the laser irradiation marks formed thereon was subjected to measurement of the coercive force Hc by sinusoidal excitation with an AC magnetic measuring instrument in two conditions including a condition of a frequency of 60 Hz and a magnetic flux density of 1.45 T and a condition of a frequency of 60 Hz and a magnetic flux density of 1.50 T.

TABLE 1

| | Alloy ribbon travelling speed S1 (m/sec) | Laser scanning speed S2 (m/sec) | S2/S1 | Distance from lens tip to ribbon (mm) | Iron loss CL (W/kg) at 60 Hz, 1.45T | Exciting power VA (VA/kg) at 60 Hz, 1.45T | Coersive force Hc (A/m) at 60 Hz, 1.45T | Iron loss CL (W/kg) at 60 Hz, 1.50T | Exciting power VA (VA/kg) at 60 Hz, 1.50T | Coercive force Hc (A/m) at 60 Hz, 1.50T |
|---|---|---|---|---|---|---|---|---|---|---|
| Comp. Ex. 1 | — | — | — | — | 0.140 | 0.181 | 3.17 | 0.146 | 0.264 | 3.16 |
| Example 1 | 5 | 165 | 33 | 550 | 0.099 | 0.182 | 2.26 | 0.110 | 0.283 | 2.38 |
| Example 2 | 2 | 66 | 33 | 550 | 0.105 | 0.164 | 2.46 | 0.117 | 0.260 | 2.53 |
| Example 3 | 1 | 21 | 21 | 370 | 0.100 | 0.160 | 2.44 | 0.109 | 0.218 | 2.43 |
| Example 4 | 1 | 11 | 11 | 370 | 0.107 | 0.158 | 2.47 | 0.120 | 0.272 | 2.57 |
| Example 5 | 1 | 7 | 7 | 370 | 0.108 | 0.176 | 2.45 | 0.119 | 0.233 | 2.51 |
| Example 6 | 0.25 | 3 | 12 | 297 | 0.100 | 0.122 | 2.36 | 0.110 | 0.145 | 2.41 |
| Example 7 | 0.25 | 2 | 8 | 297 | 0.103 | 0.128 | 2.43 | 0.114 | 0.167 | 2.52 |
| Example 8 | 0.25 | 1 | 4 | 297 | 0.102 | 0.128 | 2.43 | 0.107 | 0.194 | 2.28 |
| Comp. Ex. 2 | 0.25 | 0.5 | 2 | 297 | 0.131 | 0.143 | 3.06 | 0.146 | 0.180 | 3.21 |
| Comp. Ex. 3 | 0.1 | 0.5 | 5 | 297 | 0.135 | 0.151 | 3.04 | 0.146 | 0.171 | 3.13 |

As shown in Table 1, the amorphous alloy ribbon of Example 1 had an iron loss of 0.099 W/kg under the condition of a frequency of 60 Hz and a magnetic flux density of 1.45 T, and an iron loss of 0.110 W/kg under the condition of a frequency of 60 Hz and a magnetic flux density of 1.50 T. The amorphous alloy ribbon obtained had a low iron loss.

The amorphous alloy ribbon of Example 1 had a coercive force of 2.26 A/m under the condition of a frequency of 60 Hz and a magnetic flux density of 1.45 T, and a coercive force of 2.38 A/m under the condition of a frequency 60 Hz and a magnetic flux density of 1.50 T. The amorphous alloy ribbon obtained had a low coercive force.

The amorphous alloy ribbon of Example 1 had an exciting power of 0.182 VA/kg under the condition of a frequency 60 Hz and a magnetic flux density of 1.45 T, and an exciting power of 0.283 VA/kg under the condition of a frequency of 60 Hz and a magnetic flux density of 1.50 T. Increase in exciting power was suppressed.

As above, the single layer amorphous alloy ribbon obtained by the producing method in Example 1 had a low iron loss, a low coercive force, and a low exciting power. Accordingly, in Example 1, a laminated amorphous alloy ribbon holding spool consisting of a lamination of high performance amorphous alloy ribbons was obtained.

Examples 2 to 8, and Comparative Examples 1 to 3

The traveling speed S1 of the amorphous alloy ribbon, the scanning speed S2 of the laser, and the distance from the lens through which the laser is output to the laser radiated surface of the amorphous alloy ribbon were changed to prepare amorphous alloy ribbons having laser irradiation marks formed thereon. The amorphous alloy ribbons having the laser irradiation marks formed thereon were laminated to form a five-layered laminated amorphous alloy ribbon. The five-layered laminated amorphous alloy ribbon was wound up to prepare a laminated amorphous alloy ribbon holding spool. Each amorphous alloy ribbon used for a single layer amorphous alloy ribbon holding spool had a total length of 20000 m. As a result, a spool holding a laminated amorphous alloy ribbon with a total length of 20000 m was prepared.

Respective conditions are shown in Table 1.

Comparative Example 1 is an example of amorphous alloy ribbon that was not subjected to laser irradiation.

In each of Examples 2 to 8 and Comparative Examples 1 to 3, a sample for measurement was taken from one of the single layer amorphous alloy ribbons irradiated with the laser. Evaluation was performed in terms of the iron loss, the coercive force, and the exciting power as in Example 1. The results of the evaluation are shown in Table 1.

In Examples 1 to 8, the iron loss under the condition of a frequency 60 Hz and a magnetic flux density of 1.45 T was 0.130 W/kg or less. The amorphous alloy ribbon obtained had an extremely low iron loss. Also, the iron loss under the condition of a frequency 60 Hz and a magnetic flux density of 1.50 T was 0.145 W/kg or less. The amorphous alloy ribbon obtained had an extremely low iron loss.

In Examples 1 to 8, the coercive force under the condition of a frequency 60 Hz and a magnetic flux density of 1.45 T was 3.00 A/m or less. The amorphous alloy ribbons obtained had an extremely low coercive force. Also, the coercive force under the condition of a frequency 60 Hz and a magnetic flux density of 1.50 T was 3.10 A/m or less. The amorphous alloy ribbons obtained had an extremely low coercive force.

In Examples 1 to 8, the exciting power under the condition of a frequency of 60 Hz and a magnetic flux density of 1.45 T was 0.200 VA/kg or less. Increase in exciting power was suppressed. The exciting power tends to increase when the laser irradiation marks are formed on the amorphous alloy ribbon. In the present Examples, increase in exciting power could be suppressed. Also, the exciting power under the condition of a frequency of 60 Hz and a magnetic flux density of 1.50 T was 0.300 VA/kg or less. Under this measurement condition, increase in exciting power could be suppressed.

The linear mark of Example 1 was observed with a laser microscope, and the respective dimensions were measured. Specifically, a color 3D laser microscope VK-8710 (manufactured by KEYENCE Corporation) and a 50× objective lens CF IC EPI Plan 50X (manufactured by Nikon Corporation) (magnification of 1000×(objective lens 50x×monitor magnification 20×)) were used to photograph the surface shape. The line width WL (width of the melted solidified part) was measured based on the optical photograph. Also, irregularities on the surface of the linear mark were observed. A laser microscope (the aforementioned color 3D laser microscope VK-8710, with the same magnification) was used for observation. Specifically, a profile in the width direction of the linear mark was measured with the laser microscope. At this time, a width of about 30 μm was added to the front and the rear of the line width WL, and the profile therebetween (30 μm+line width WL+30 μm) was measured. Based on this profile, a height difference HL was measured. In a case where the profile was tilted, the tilt was linearly corrected for measurement, using the margin of 30 μm added to each of the front and the rear, so that the profile is in a horizontal direction.

As a result, the difference HL between the highest point and the lowest point of the linear mark of Example 1 was 0.73 μm, and the line width WL was 78.63 μm. HL×WL calculated based on the difference HL between the highest point and the lowest point of the linear mark and the line width WL of the linear mark was 57.40 $\mu m^2$.

As above, according to the Examples of the present disclosure, an amorphous alloy ribbon that enables efficient laser irradiation and has high performance could be obtained. Also, according to the Examples of the present disclosure, the laser is radiated to a long amorphous alloy ribbon, which continues to travel. Moreover, the laser irradiation is followed by lamination of a five-layered laminated amorphous alloy ribbon and winding up of the five-layered laminated amorphous alloy ribbon. Thus, high productivity is achieved. As above, the producing method of the present disclosure achieves efficient laser irradiation and continuous lamination. Moreover, high performance amorphous alloy ribbons can be obtained and such high performance amorphous alloy ribbons are laminated. Furthermore, the producing method is a method of producing a spool holding a laminated amorphous alloy ribbon with high productivity.

Figure 5:
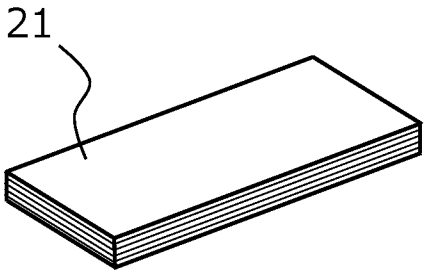
FIG. 5 is a perspective view showing one example of a laminated amorphous alloy ribbon piece of the present disclosure.

FIG. 5 illustrates an example of unwinding a laminated amorphous alloy ribbon from the laminated amorphous alloy ribbon holding spool of the present disclosure and working the unwound laminated amorphous alloy ribbon, to thereby form laminated amorphous alloy ribbon pieces of a desired shape. FIG. 5 is an example of a laminated amorphous alloy ribbon piece cut into a rectangular shape. The required number of laminated amorphous alloy ribbon pieces 21 can be laminated, to thereby form an iron core. An example of such an iron core is illustrated in FIG. 6.

Also, there may be provided laminated amorphous alloy ribbon holding spools. Laminated amorphous alloy ribbons may be unwound from the respective laminated amorphous alloy ribbon holding spools and worked, to thereby prepare laminated amorphous alloy ribbon pieces of a desired shape. An iron core may be formed with the laminated amorphous alloy ribbon pieces.

Figure 6:
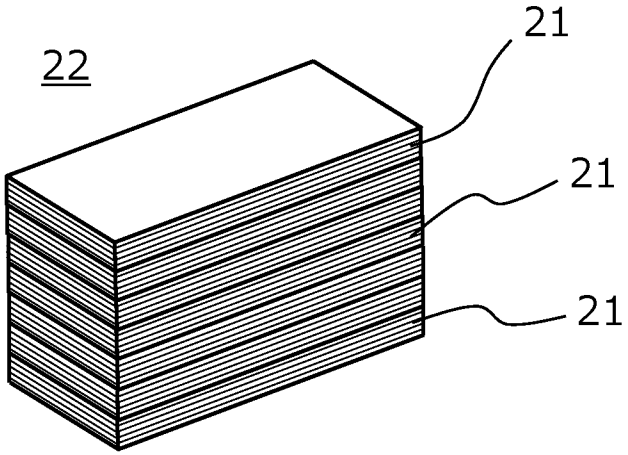
FIG. 6 is a perspective view showing one example of an iron core with formed with the laminated amorphous alloy ribbon pieces of FIG. 5.

The iron core illustrated in FIG. 6 has a rectangular shape. A plurality of the iron cores may be combined, to thereby form an iron core.

The shape of iron core is not limited to the shape illustrated in FIG. 5. That is, the laminated amorphous alloy ribbon can be worked into a shape in accordance with applications and required for an iron core, to thereby form an iron core having a shape other than a rectangular shape.

Figure 7:
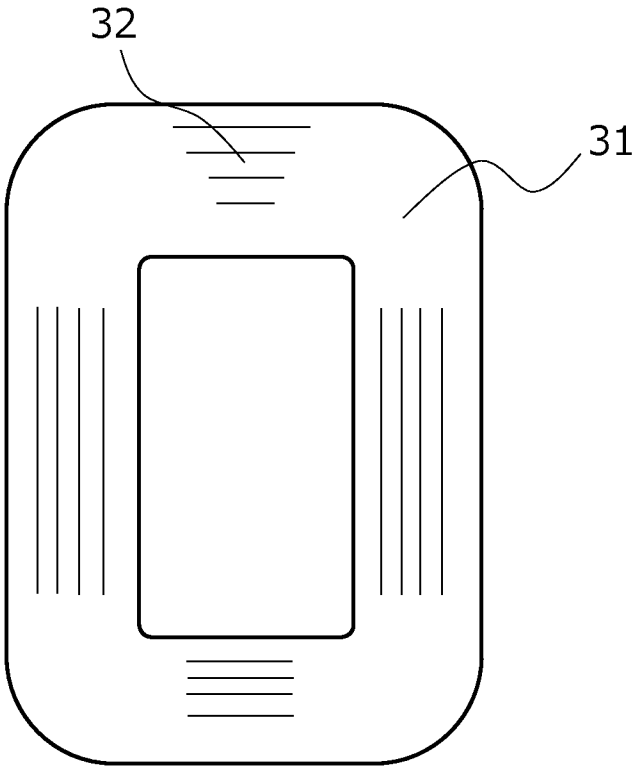
FIG. 7 is a schematic diagram illustrating one example of the iron core formed with the laminated amorphous alloy ribbon pieces of the present disclosure.

Furthermore, FIG. 7 shows an example of a circular iron core 31 formed by unwinding a laminated amorphous alloy ribbon from the laminated amorphous alloy ribbon holding spool of the present disclosure, working the unwound laminated amorphous alloy ribbon, to form laminated amorphous alloy ribbon pieces of a desired shape, laminating the required number of the laminated amorphous alloy ribbon pieces, and bending the lamination of the laminated amorphous alloy ribbon pieces to overlap its ends with each other. An upper portion of the iron core 31 is an overlapped portion 32.

Still furthermore, there may be provided laminated amorphous alloy ribbon holding spools. Laminated amorphous alloy ribbons may be unwound from the respective laminated amorphous alloy ribbon holding spools and worked, to thereby prepare laminated amorphous alloy ribbon pieces of a desired shape. An iron core may be formed with the laminated amorphous alloy ribbon pieces.

As presented in the Examples above, according the present disclosure, an iron core can be formed with a laminated amorphous alloy ribbon on which laser irradiation marks have been formed and that consists of a lamination of high performance amorphous alloy ribbons. Thus, it is possible to form a high performance iron core.

Still furthermore, it is also possible to prepare laminated amorphous alloy ribbon pieces of a desired shape while a laminated amorphous alloy ribbon is being unwound. Thus, it is also possible to efficiently prepare an iron core.

What is claimed is:

1. A method of producing a laminated amorphous alloy ribbon holding spool comprising:

providing single layer amorphous alloy ribbon holding spools, each of which is wound with a single layer amorphous alloy ribbon;

unwinding the single layer amorphous alloy ribbon from each of the single layer amorphous alloy ribbon holding spools;

making the single layer amorphous alloy ribbon travel with a laser being radiated thereto, to thereby simultaneously prepare single layer amorphous alloy ribbons having laser irradiation marks formed thereon;

laminating the single layer amorphous alloy ribbons having the laser irradiation marks formed thereon, to thereby prepare a laminated amorphous alloy ribbon; and winding up the laminated amorphous alloy ribbon on a spool.

2. The method of producing a laminated amorphous alloy ribbon holding spool according to claim 1, wherein when the single layer amorphous alloy ribbon has a traveling speed of 51 m/sec and the laser has a scanning speed of S2 m/sec, the S1 is 0.1 m/sec or more and 30 m/sec or less, the S2 is 1 m/sec or more and 800 m/sec or less, and S2/S1 is 3.0 or more.

3. The method of producing a laminated amorphous alloy ribbon holding spool according to claim 1, wherein an angle difference between a scanning direction of the laser and a direction orthogonal to a traveling direction of the single layer amorphous alloy ribbon is 30 degrees or less.

4. The method of producing a laminated amorphous alloy ribbon holding spool according to claim 1, wherein a distance from a lens through which the laser is output to a surface of the single layer amorphous alloy ribbon is 200 mm to 1200 mm.

5. The method of producing a laminated amorphous alloy ribbon holding spool according to claim 1, wherein the laser uses a CW (continuous wave) oscillation method.

6. The method of producing a laminated amorphous alloy ribbon holding spool according to claim 5, wherein the laser using a CW (continuous wave) oscillation method has a laser output energy density of 5 J/m or more and 35 J/m or less.

7. The method of producing a laminated amorphous alloy ribbon holding spool according to claim 1, wherein the laser is a pulse laser.

8. The method of producing a laminated amorphous alloy ribbon holding spool according to claim 7, wherein the pulse laser has a laser pulse output energy of 0.4 mJ to 2.5 mJ.

9. The method of producing a laminated amorphous alloy ribbon holding spool according to claim 1, wherein the single layer amorphous alloy ribbon has a width of 30 mm to 300 mm, and a thickness of 18 μm to 35 μm.

10. The method of producing a laminated amorphous alloy ribbon holding spool according to claim 1, wherein the laser irradiation marks are linear marks formed in a width direction of the single layer amorphous alloy ribbon and the linear marks are formed in a longitudinal direction of the single layer amorphous alloy ribbon with an interval left.

11. The method of producing a laminated amorphous alloy ribbon holding spool according to claim 10, wherein the interval between the linear marks in the longitudinal direction of the single layer amorphous alloy ribbon is 2 mm to 200 mm.

12. The method of producing a laminated amorphous alloy ribbon holding spool according to claim 1, wherein a mechanism for suppressing oscillation the single layer amorphous alloy ribbon is provided in front and rear of a portion of the single layer amorphous alloy ribbon to be irradiated with the laser.

13. The method of producing a laminated amorphous alloy ribbon holding spool according to claim 12, wherein the mechanism for suppressing oscillation of the single layer amorphous alloy ribbon adjusts a traveling position of the single layer amorphous alloy ribbon with rolls.

14. A method of producing a laminated amorphous alloy ribbon holding spool comprising:

providing laminated amorphous alloy ribbon holding spools obtained by the method according to claim 1;

unwinding laminated amorphous alloy ribbons from the laminated amorphous alloy ribbon holding spools;

laminating the laminated amorphous alloy ribbons, to thereby prepare a laminated amorphous alloy ribbon; and winding up the laminated amorphous alloy ribbon on a spool.

15. A method of producing an iron core comprising:

unwinding a laminated amorphous alloy ribbon from at least one laminated amorphous alloy ribbon holding spool, the at least one laminated amorphous alloy ribbon holding spool being obtained by a method of producing a laminated amorphous alloy ribbon holding spool including:

providing single layer amorphous alloy ribbon holding spools, each of which is wound with a single layer amorphous alloy ribbon;

unwinding the single layer amorphous alloy ribbon from each of the single layer amorphous alloy ribbon holding spools;

making the single layer amorphous alloy ribbon travel with a laser being radiated thereto, to thereby simultaneously prepare single layer amorphous alloy ribbons having laser irradiation marks formed thereon;

laminating the single layer amorphous alloy ribbons having the laser irradiation marks formed thereon, to thereby prepare a laminated amorphous alloy ribbon; and winding up the laminated amorphous alloy ribbon on a spool;

working the laminated amorphous alloy ribbon, to thereby form laminated amorphous alloy ribbon pieces; and laminating the laminated amorphous alloy ribbon pieces and/or bending the laminated amorphous alloy ribbon pieces, to thereby form an iron core.

16. The method of producing an iron core according to claim 15, wherein the at least one laminated amorphous alloy ribbon holding spool includes laminated amorphous alloy ribbon holding spools, the method comprising:

unwinding a laminated amorphous alloy ribbon from each of the laminated amorphous alloy ribbon holding spools;

working the laminated amorphous alloy ribbon, to thereby form laminated amorphous alloy ribbon pieces; and laminating the laminated amorphous alloy ribbons and/or bending the laminated amorphous alloy ribbons.

* * * * *